US006872177B1

(12) United States Patent
Fullington

(10) Patent No.: US 6,872,177 B1
(45) Date of Patent: Mar. 29, 2005

(54) CARD CREASING AND EMBOSSING DEVICE

(75) Inventor: Dwight E. Fullington, 41419 Rue Jadot, Temecula, CA (US) 92591

(73) Assignee: Dwight E. Fullington, Temecula, CA (US)

( * ) Notice: Subject to any disclaimer, the term of this patent is extended or adjusted under 35 U.S.C. 154(b) by 0 days.

(21) Appl. No.: 10/753,993

(22) Filed: Jan. 8, 2004

(51) Int. Cl.[7] ..... B31B 1/26

(52) U.S. Cl. ..... 493/405; 493/455; 493/356; 493/231

(58) Field of Search ..... 493/405, 455, 493/356, 231

(56) References Cited

U.S. PATENT DOCUMENTS 766,905 A * 8/1904 Ruth ..... 493/351
4,820,255 A * 4/1989 Nanami ..... 493/451
5,226,872 A * 7/1993 Watson ..... 493/457
5,615,123 A 3/1997 Davidson et al.
5,733,237 A * 3/1998 Marschke et al. ..... 493/405
5,989,173 A * 11/1999 Lugea et al. ..... 493/356
6,090,030 A * 7/2000 Rogers ..... 493/363
6,349,639 B1 2/2002 Smith et al.
6,612,433 B2 * 9/2003 McKenzie ..... 206/308.1
6,695,758 B2 * 2/2004 Dostie ..... 493/405

* cited by examiner

*Primary Examiner*—Rinaldi I. Rada
*Assistant Examiner*—Hemant M Desai

(57) ABSTRACT

The present invention is a card creasing and embossing device. In particular, the present invention is directed to a device for creasing and embossing greeting cards. A preferred embodiment of the invention comprises a base plate supporting a plurality of crease plates in a stack. The base plate has a top side with a crease line depression and each of the plurality of crease plates have a top side and bottom side whereby the top side of one crease plate opposes the bottom side of an adjoining crease plate. The top side of each crease plate has at least one crease line depression; the bottom side of each crease plate has at least one crease blade for insertion into at least one crease line depression on the adjoining crease plate top side. The crease plates preferably each have a selection tab indicating the fold configuration for the crease plate. The preferred embodiment of the invention has a paper cutter hingedly connect on its top. The crease plates preferably have paper guide depressions. The invention also preferably comprises a set of interchangeable embossing plates and a set of perimeter embossing plates.

5 Claims, 4 Drawing Sheets

CARD CREASING AND EMBOSSING DEVICE

TECHNICAL FIELD

The present invention is a card creasing and embossing device. In particular, the present invention is directed to a device for creasing and embossing greeting cards.

BACKGROUND ART

Systems for creating and embossing greeting cards are known such as U.S. Pat. Nos. 5,615,123 and 6,349,639. However, these devices are often larger, expensive and/or require pre-scored card stock to function. The technology exists for users to create and print greeting cards on high quality card stock at home with a home computer and printer. However, the card stock, as a heavier bond paper, is often difficult to crease into a standard greeting card configuration. As card stock is often more expensive than regular paper, this can discourage users from attempting to make their own greeting cards at home. Embossing card stock while aesthetically pleasing can also pose similar problems. Thus, a simple, less expensive device that can crease and emboss card stock without pre-scoring is desirable.

SUMMARY OF THE INVENTION

The present invention is a card creasing and embossing device. In particular, the present invention is directed to a device for creasing and embossing greeting cards. A preferred embodiment of the invention comprises a base plate supporting a plurality of crease plates in a stack. The base plate has a top side with a crease line depression and each of the plurality of crease plates have a top side and bottom side whereby the top side of one crease plate opposes the bottom side of an adjoining crease plate. The top side of each crease plate has at least one crease line depression; the bottom side of each crease plate has at least one crease blade for insertion into at least one crease line depression on the adjoining crease plate top side. The crease plates preferably each have a selection tab indicating the fold configuration for the crease plate. A preferred embodiment of the invention has a paper cutter hingedly connect on its top. The crease plates preferably have paper guide depressions. The invention also preferably comprises a set of interchangeable embossing plates and a set of perimeter embossing plates.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a card creasing and embossing device.

Figure 1:
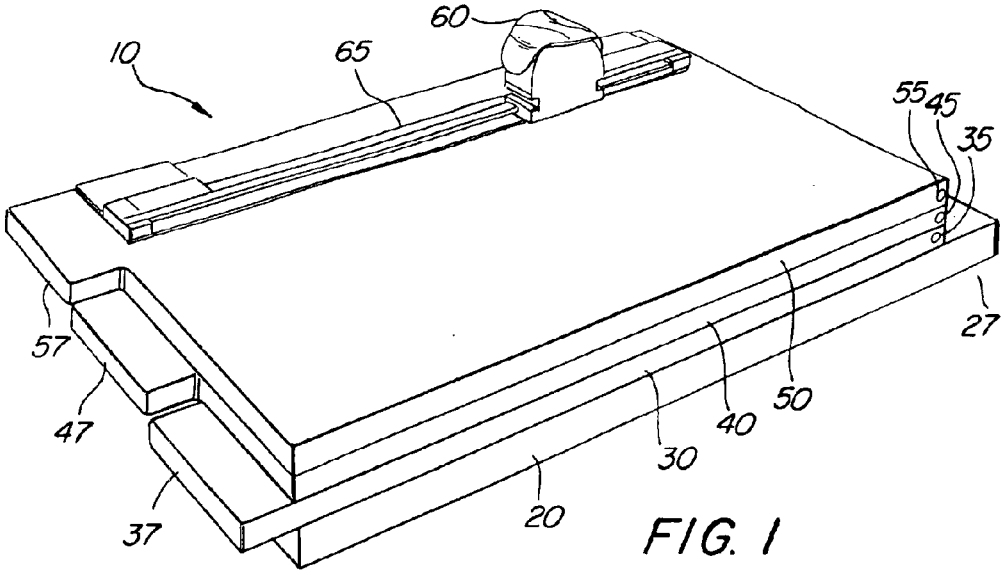
FIG. 1 is a perspective view of a preferred embodiment of the invention.

Referring now to FIG. 1, a preferred embodiment of the invention 10 is shown. A base plate 20 comprises a balance tab 27 at an edge and supports a stack of crease plates (30, 40, and 50.) The crease plates (30, 40 and 50) are preferably hingedly connected at reference points 35, 45 and 55 respectively. Furthermore, the crease plates 30, 40 and 50 have selection tabs 37, 47 and 57 opposing the balance tab 27. The selection tabs 37, 47 and 57 are used for, infer alia, selecting the desired fold configuration for use. A paper cutter 60 with guide 65 is hinged to the top crease plate 50.

Figure 2:
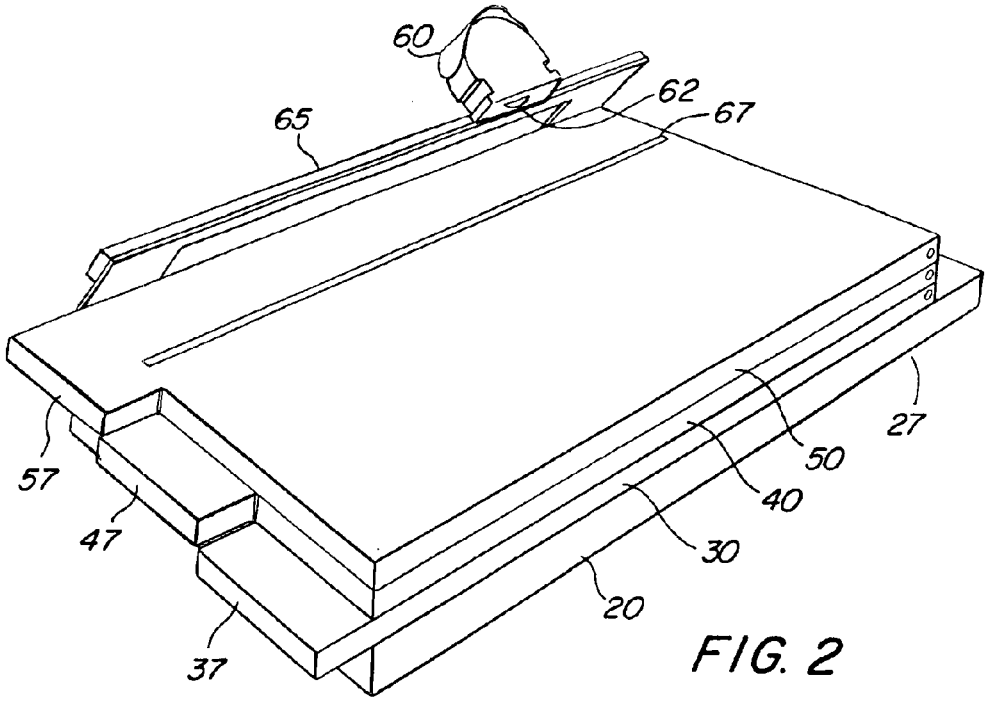
FIG. 2 is a perspective view of a preferred embodiment of the invention.

Referring now to FIG. 2, it shows the paper cutter 60 open to receive paper for cutting. The paper cutter 60 preferably has a blade 62 that traverses the guide 65 through a paper cutter depression 67 on top of crease plate 50. The guide 65 and depression 67 assist in providing a straight edge cut to paper inserted into the cutter 60.

Figure 3:
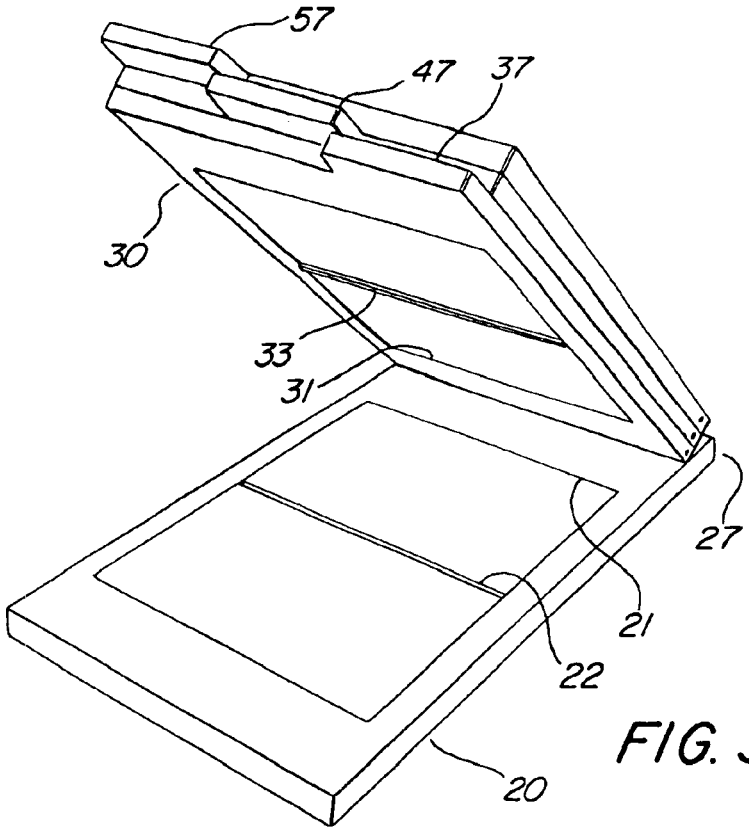
FIG. 3 is a perspective view of a preferred embodiment of the invention open to a half-fold crease configuration.

Referring now to FIG. 3, a preferred embodiment of the invention 10 is open to a half-fold crease configuration. As shown, the top side of the base plate 20 has a half-fold crease line depression 22. The bottom side of the opposing plate or first plate 30 has a half-fold crease blade 33 that is insertable into the half-fold crease line depression 22. The plates 20 and 30 further comprise paper guide depressions 21 and 31. Thus, when a piece of card stock 100 or other paper is inserted into the paper guide depression 21 and the plates 20 and 30 are closed, the crease blade 33 creases the card stock 100 by pressing the card stock into the depression 22. By using the configuration shown in FIG. 3, the card stock 100 is folded in half.

Also shown in FIG. 3 is the preferred function of the balance tab 27 on the base plate 20. As shown, when the stack of crease plates (30, 40 and 50) is open in any of the available crease configurations, the balance tab 27 provides a pivot point for the plate 30, 40 and 50 on which to hinge. Thus, a more firm and stable base is provided for the invention. Moreover, the balance tab 27 preferably opposes the weight and moment of the selection tabs 37, 47 and 57 on the stack of crease plates.

Figure 4:
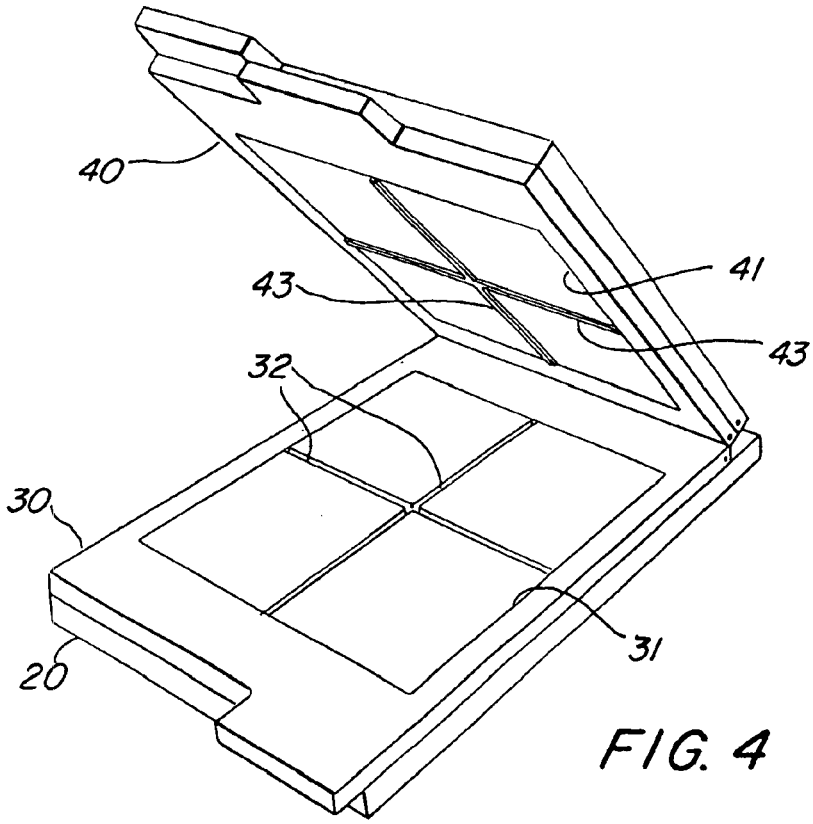
FIG. 4 is a perspective view of a preferred embodiment of the invention open to a quarter-fold crease configuration.

Referring now to FIG. 4, a preferred embodiment of the invention 10 is open to a quarter-fold crease configuration. As shown, the top side of the first plate 30 has two intersecting quarter-fold crease line depressions 32. The bottom side of the opposing plate or second plate 30 has two intersecting quarter-fold crease blades 43 that are insertable into the two quarter-fold crease line depressions 32. The plates 30 and 40 again further comprise paper guide depressions 31 and 41. Thus, when a piece of card stock 100 or other paper is inserted into the paper guide depression 31 and the plates 30 and 40 are closed, the crease blades 43 crease the card stock 100 by pressing the card stock into the depressions 32. By using the configuration shown in FIG. 4, the card stock 100 is folded in quarters.

Figure 5:
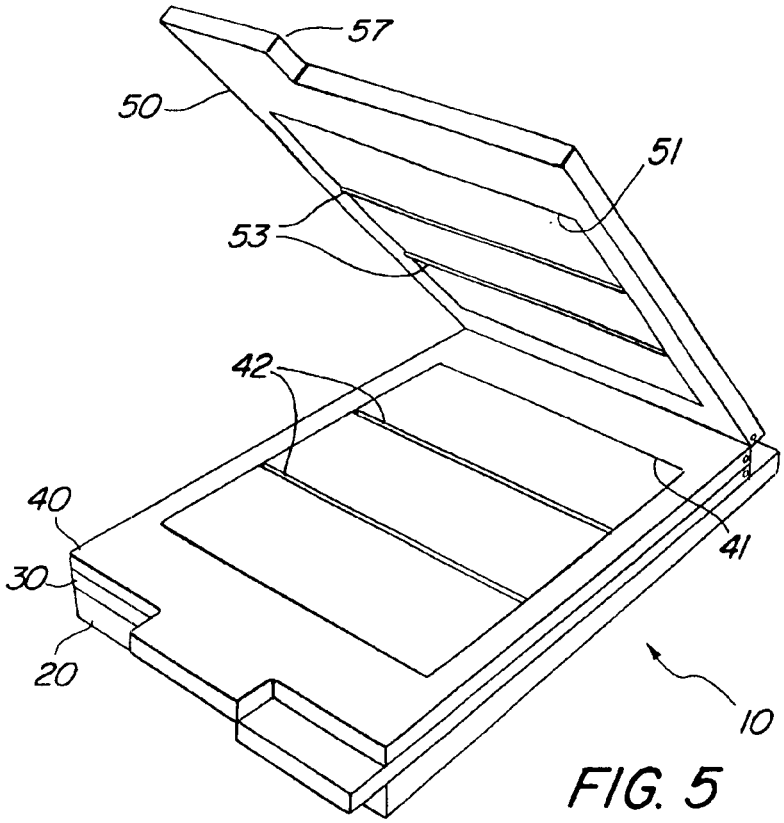
FIG. 5 is a perspective view of a preferred embodiment of the invention open to a tri-fold crease configuration.

Referring now to FIG. 5, a preferred embodiment of the invention 10 is open to a tri-fold crease configuration. As shown, the top side of the second plate 40 has two tri-fold crease line depressions 42. The bottom side of the opposing plate or third plate 50 has two tri-fold crease blades 53 that are insertable into the two tri-fold crease line depressions 42. The plates 40 and 50 again further comprise paper guide depressions 41 and 51. Thus, when a piece of card stock 100 or other paper is inserted into the paper guide depression 41 and the plates 40 and 50 are closed, the crease blades 53 crease the card stock 100 by pressing the card stock into the depressions 42. By using the configuration shown in FIG. 5, the card stock 100 is folded in three parts or a tri-fold.

Figure 6:
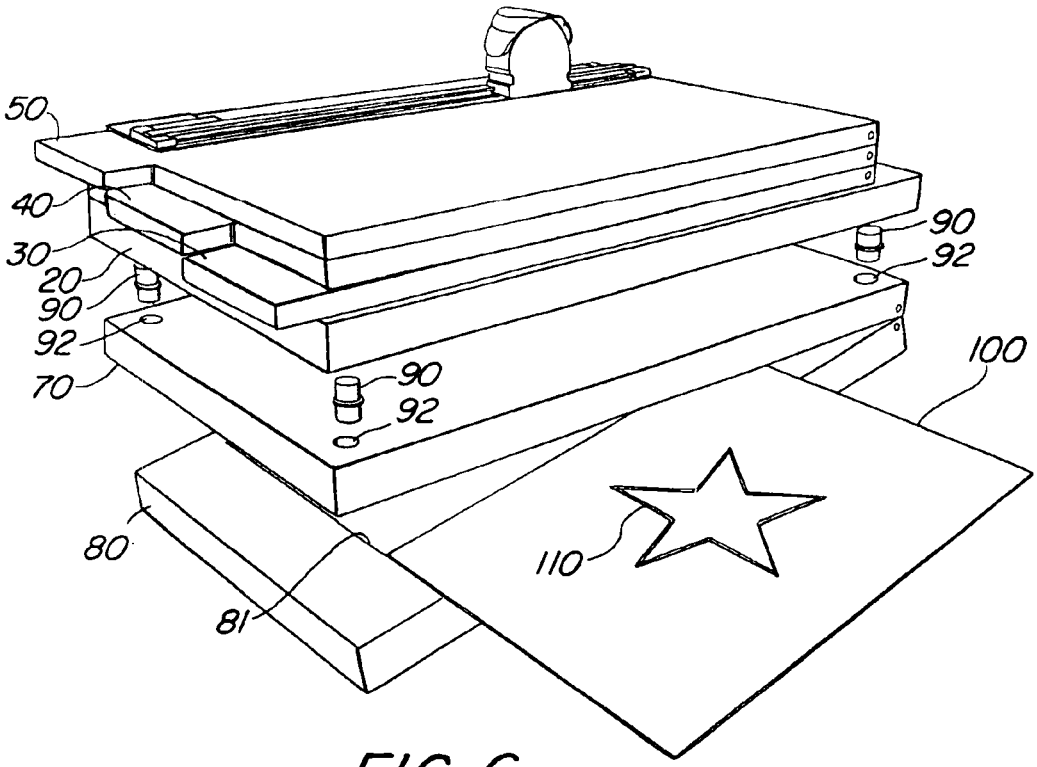
FIG. 6 is a perspective view of a preferred embodiment of the invention with an embossing base.
Figure 7:
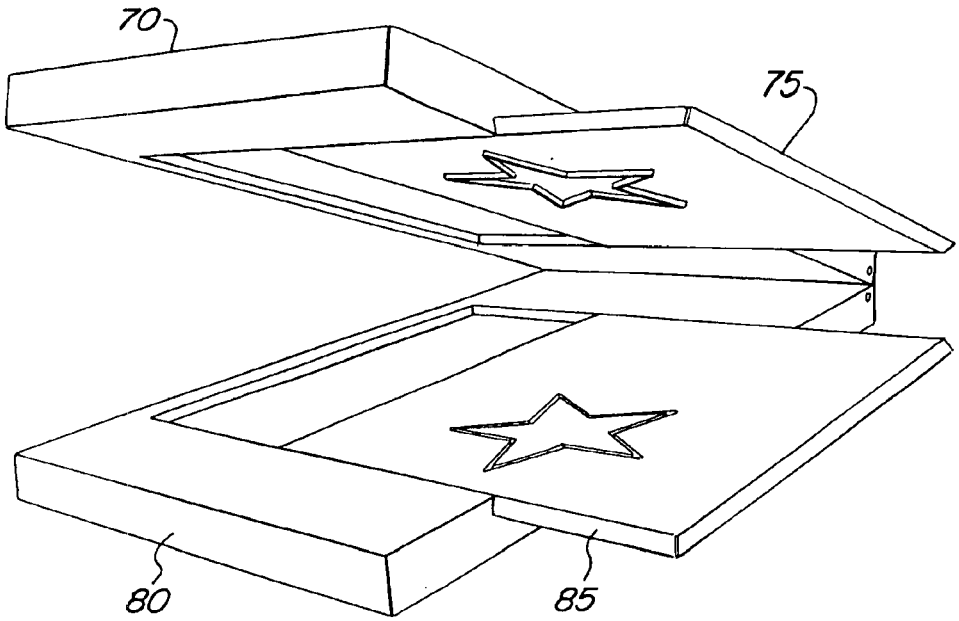
FIG. 7 is a perspective view of a preferred embodiment of the embossing base of the invention open to insertion of embossing plates; and, FIG. 8 is a perspective view of a preferred embodiment of the invention open to a perimeter embossing configuration.

Referring now to FIG. 6, another preferred embodiment of the invention 10 is shown, preferably for embossing card stock. The base plate 20 is removably attached to a set of embossing plates 70 and 80 by spacers 90. Preferably, the top embossing plate has a set of spacer holes 92 for the spacers 90. The top and bottom embossing plates 70 and 80 are preferably hingedly connected at an edge and have paper guides 71 and 81. As shown in FIG. 7, the top side of the bottom embossing plate 80 preferably has an interchangeable depression plate with an embossing design 85. The bottom side of the top embossing plate 70 preferably has an interchangeable impression plate with an embossing design 75 that inserts into the depression plate embossing design 85 on the bottom embossing plate. Thus, when a piece of card stock 100 or other paper is inserted into the paper guide depression 81 and the plates 70 and 80 are closed, the impression plate 75 embosses a design on the card stock 100 by pressing the card stock into the depression plate embossing design 85. By using the configuration shown in FIG. 6, the card stock 100 has been embossed with a star design 110. Preferably, the design plates 75 and 85 can be removed from the embossing plates 70 and 80 and new design plates can be inserted for new and different designs.

An alternative embodiment to the embodiment shown in FIG. 6 has a set of embossing plates 70 and 80 that are extended in length beyond the base plate 20. Just as the balance tab 27 of the base plate 20 is preferably extended beyond the length of crease plates 30, 40 and 50, the embossing plates 70 and 80 can be extended beyond the length of the base plate 20 to improve balance of the invention.

Figure 8:
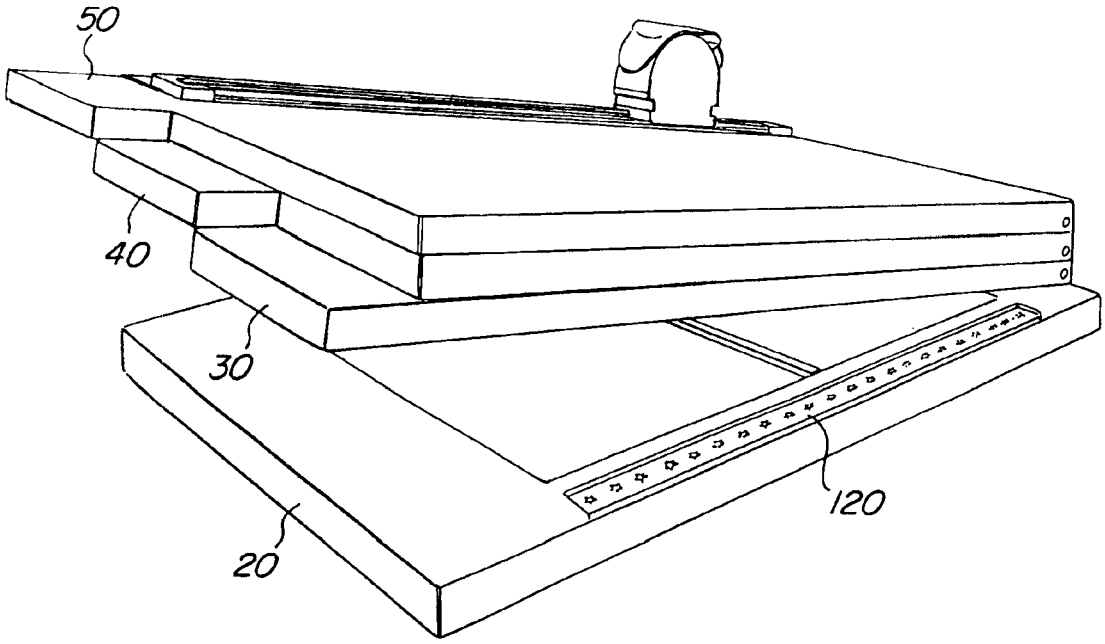

Referring now to FIG. 8, an alternative preferred embodiment of the invention is shown open to a perimeter embossing configuration. As shown, the edge of base plate 20 has a perimeter embossing plate 120 (small star design shown) to place a design on the edge of a piece of card stock. Alternately, perimeter embossing plates 120 can be present on crease plates 30, 40 and/or 50 or the embossing plates 70 and 80. The perimeter embossing plates 120 are preferably interchangeable with other designs.

Thus, a card creasing and embossing device is described above that is a smaller, simpler, and less expensive device that can crease and emboss card stock without pre-scoring. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. For example, alternately, the crease line blades can be mounted to the top side of the various plates with corresponding crease line depressions on the opposing bottom sides of the various plates. Likewise, the impression and depression embossing plates could be reversed. Moreover, the invention is preferably made of hard plastic, e.g. ABS plastic. However, alternately, it can be constructed from metal or a combination of plastic and metal. Therefore, it is to be understood that, within the scope of the appended claims, the invention may be practiced other than as specifically described herein.

What is claimed is:

1. A card creasing device comprising:

a base plate having a top side, the top side having a half-fold crease line depression; the base plate hingedly connected to a first plate at a bottom side edge of the first plate;

the first plate further having a top side and a bottom side, the bottom side having a half fold crease blade that is insertable into the half-fold crease line depression of the base plate when the first plate rests on the base plate; the top side of the first plate having two intersecting quarter-fold crease line depressions; the first plate being hingedly connected to a second plate at a top side edge of the first plate and a bottom side edge of the second plate;

the second plate further having a top side and a bottom side; the bottom side having two intersecting quarter-fold crease blades that are insertable into the two intersecting quarter-fold crease line depressions of the top side of the first plate when the second plate rests on the first plate; the top side of the second plate having two tri-fold crease line depressions; the second plate being hingedly connected to a third plate at a top side edge of the second plate and a bottom side edge of the third plate; and, the third plate further having a top side and a bottom side; the bottom side having two tri-fold crease blades that are insertable into the two tri-fold crease line depressions on the top side of the second plate when the third plate rests on the second plate.

2. The card creasing device of claim 1 further comprising a paper cutter hingedly connected to the top side of the third plate.

3. The card creasing device of claim 1 where the base plate further comprises a balance tab extended beyond the edge of the first plate and where the first plate has a first plate selection tab opposed to the balance tab; the second plate has a second plate selection tab opposed to the balance tab; and the third plate has a third plate selection tab opposed to the balance tab.

4. The card creasing device of claim 1 further comprising a top embossing plate hingedly connected to a bottom embossing plate; where both are removably mounted below the base plate.

5. The card creasing device of claim 1 where the base plate, first plate, second plate and third plate each have paper guide depressions.

* * * * *